US007012497B2

(12) United States Patent
Steingroever

(10) Patent No.: US 7,012,497 B2
(45) Date of Patent: Mar. 14, 2006

(54) TRANSFORMER FOR PRODUCING HIGH ELECTRICAL CURRENTS

(75) Inventor: Dietrich Steingroever, Bergisch Gladbach (DE)

(73) Assignee: Magnet-Physik Dr. Steingroever GmbH, Cologne (DE)

( * ) Notice: Subject to any disclaimer, the term of this patent is extended or adjusted under 35 U.S.C. 154(b) by 159 days.

(21) Appl. No.: 10/764,753

(22) Filed: Jan. 26, 2004

(65) Prior Publication Data

US 2004/0155748 A1 Aug. 12, 2004

(30) Foreign Application Priority Data

Feb. 5, 2003 (DE) ..... 103 04 606

(51) Int. Cl.
*H01F 27/28* (2006.01)

(52) U.S. Cl. ..... 336/232

(58) Field of Classification Search ..... 336/65, 336/83, 90, 200–208, 232
See application file for complete search history.

(56) References Cited

U.S. PATENT DOCUMENTS 5,359,313 A * 10/1994 Watanabe et al. ..... 336/178
5,684,445 A * 11/1997 Kobayashi et al. ..... 336/83
6,522,233 B1 * 2/2003 Kyoso et al. ..... 336/200

FOREIGN PATENT DOCUMENTS

| | | |
|---|---|---|
| DE | 36 10 690 A1 | 10/1987 |
| DE | 44 23 992 A1 | 2/1995 |
| DE | 198 47 981 A1 | 4/2000 |
| DE | 100 20 708 A1 | 11/2001 |

* cited by examiner

*Primary Examiner*—Tuyen T Nguyen
(74) *Attorney, Agent, or Firm*—Michael J. Striker

(57) ABSTRACT

A transformer (1) serves to produce high electrical currents, in particular, for transforming high alternating and power pulse currents for producing magnetic fields in magnetic technology for magnetizing magnets and magnetic systems, as well as in conversion technology for forming electrically conductive materials by means of a magnetic field. The transformer has at least one primary coil (2) and at least one secondary part (3), which are connected with bus bars (4, 5). The secondary part (3) of the transformer (1) includes at least one electrically conductive plate (6), in which at least one cut-out penetrating the plate (6) is disposed. At least one slit (8) originating from the cut-out (7) is provided, which separates the plate (6) on one side of each cut-out (7) into two parts and produces the required bus bar (5).

18 Claims, 4 Drawing Sheets

TRANSFORMER FOR PRODUCING HIGH ELECTRICAL CURRENTS

BACKGROUND OF THE INVENTION

The present invention relates to a transformer for producing high electrical currents.

With a transformer known from DE 44 23 992 C2 for production of high electrical impulse currents, which is part of an electromagnetic generator for quick current and magnetic field impulse for production of magnetic fields in conversion technology of electrically conductive materials by means of a magnetic field, the primary coil is coiled as an elongated coil in a spiral on a longitudinally slotted supported tube made from copper or another electrically conductive material, which forms the secondary coil with an iron core and are welded or screwed onto the contact block for the current output to a high current loop on the secondary side of the transformer on both sides of the longitudinal slit. The contact blocks are disposed in the center of the support tube, which is provided on each side of the two contact blocks with this type of primary coil.

With a different type of impulse-transformer with one or more primary coils arranged on a tube-shaped, longitudinally slotted high current conductor (DE 198 47 981 A1), the high current conductor comprises a flange fixedly connected with the conductor, which, like the high current conductor, is made from a massive electrically-good conductive material and projects out over the diameter of the primary coils.

With a further known, multi-winding coil for producing intense magnetic field impulses (DE 100 20 708 A1), a one-layer cylinder coil is coiled from rectangular copper wire braided with glass fiber and is surrounded by a copper tube with a longitudinal slit. The copper tube surrounding the coil is coated on its inner side with a polyimide film with increased heat conductivity for additional electrical insulation. In addition, the copper tube, as far as it surrounds the coil, is wrapped with a thick reinforcement made from para-aramide tread. This system made from copper coiling, slotted copper tube, and outer reinforcement is soaked with epoxy resin.

Such transformers with helically wound primary coils are mechanically very expensive to make. They are not constructed modularly. In addition, with these transformers, the high mechanical forces occurring with high currents between the primary and second coils are not compensated.

One object of the present invention is to provide a transformer, which is mechanically simple and cost-effective to produce, and which is formed, such that the high mechanical forces occurring between the primary coil and secondary part are compensated. The transformer, in addition, should be modularly constructed, and therefore, can be adapted to different applications.

This object is resolved with a transformer according to the present invention, in which the secondary part of the transformer comprises at least one electrically conductive plate, in which at least one cut-out penetrating the plate is disposed, which is provided with at least one slit originating from the cut-out, which separates the plate on one side of each cut-out into two parts and which produces the necessary bus bars, and wherein in rings about each cut-out, a primary coil with its bus bars can be electrically insulated in the plate.

The invention has the advantage that such a transformer can be made without an iron core with a very high transfer factor $I_2:I_2>0.84$ in a simple manner according to the power requirements with one or more plate-shaped secondary parts. The required secondary parts, therefore, can be made of plates with high electrical conductivity, such as copper, aluminum, or their alloys with chromium and/or zircon, for example, Cu Cr Zr-alloys, in which each individual plate is made with one or more, preferably circular cut-out and an annular groove surrounding each cut-out, in which, then, a flat, disk-shaped coil can be placed as the primary coil and encapsulated with insulating material.

The primary coil can be wound in a simple and most space-saving manner from the inside to the outside in the opposite direction, so that both bus bars can contact the primary coil on the outer circumference of the coil or winding.

This has the particular advantage that no return from the center of the coil is required, as with common coils. Such a return from the center of the coil produces necessary air gaps, which lead to a minimal coil tightness and, thus, the electrical coupling factor or the electrical efficiency of the transformer can be effected detrimentally, since in the air gaps, magnetic fields exist about the electrical conductor or the coil windings, whose flow lines do not go through the secondary part, thus leading to transfer loss with the production of the secondary current.

With the present invention, therefore, in particular, a high space factor of the coiling as a result of minimal parasitic air gaps between the primary and secondary parts is particularly advantageous.

Alternatively to the embodiment of the transformer of the present invention with an iron core, the transformer can be equipped also with an iron core. The iron can affect an improvement of the transfer factor, up to a determined current strength, which must be determined separately from case to case with measurement technologies, but runs with increasing current strength and exceeds a determined boundary flattened according to a characteristic line, which must be determined separately.

Instead of a primary coil made from a wire-type electrical conductor, magnetic coils according to DE 36 10 690 C2 can be used as the primary coil, which comprises multiple disks arranged in a stack and braced rigidly together with a central opening, whereby each disk has a radial slit originating from the central opening with electrical terminals arranged on both sides and includes an inner, ring-shaped region guiding the current as well as a heat conducting, outer region with further radial slits. The individual disks are connected in a spiral to one another in a series. This has the advantage of a particularly compact, high-duty structure with a high transfer factor and, therefore, a particularly favorable electrical efficiency.

DETAILED DESCRIPTION OF THE PREFERRED EMBODIMENTS

Figure 1:
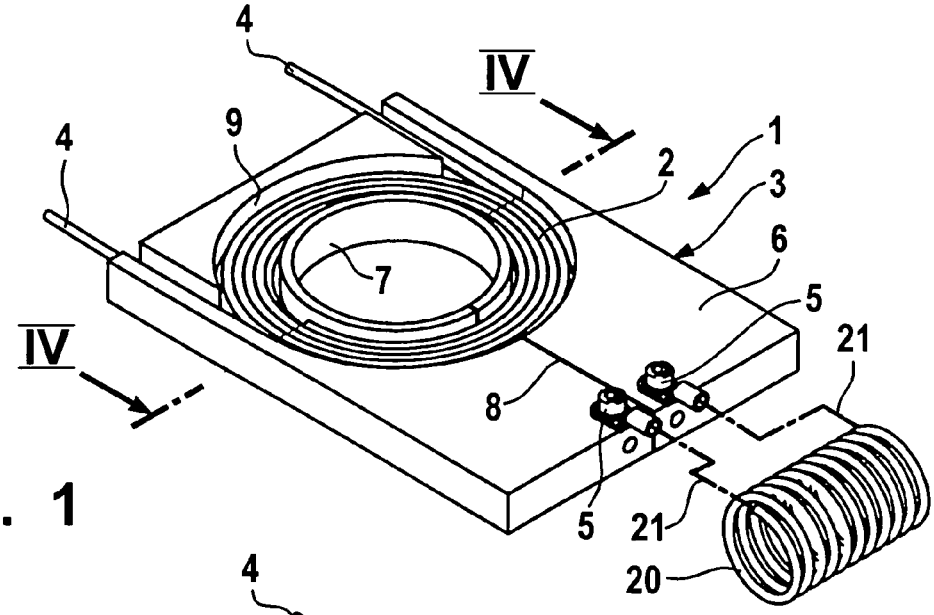
FIG. 1 shows a first embodiment of a transformer with bus bars on the secondary part, on which a coil is connected with an electrical cable as a consumer.

The transformer 1 shown in various embodiments serves to produce high electrical currents. In particular, it is suited for transformation of high alternating currents as well as power pulse currents for producing magnetic fields in magnetizing technology for magnetizing magnets and magnetic systems, as well as in conversion technology for forming electrically conductive materials by means of magnetic fields. The transformer 1, in its simplest embodiments, comprises at least one primary coil 2 and at least one secondary part 3, which are connected with electrical terminals or bus bars 4 and 5.

As shown in FIGS. 1 through 4, the secondary part 3 of the transformer comprises at least one electrically conductive plate 6, in which at least one cut-out 7 penetrating the plate 6 is located. On the plate 6, in addition, a slit 8 originating from the cut-out 7 is provided, which separates the plate 6 on one side of the cut-out into two parts and which produces the necessary bus bars. A primary coil 2 with its bus bars 4 can be electrically insulated in the plate encircling the cut-out 7.

The cut-out 7 on the plate 6 is surrounded by an annular groove 9 that receives the primary coil 2, in which the primary coil 2 is placed and is encapsulated with insulating material 10.

The plate 6 has a separating wall 11 encircling the cut-out 7 and projecting over the primary coil 2 on its inner circumference, whose height is the same as the thickness of the plate 6. The annular groove 9 has a substantially U-shaped cross-section and is open to a flat side of the plate 6.

The cut-out 7 on the plate 6 has a round or polygonal cross section.

Figure 4:
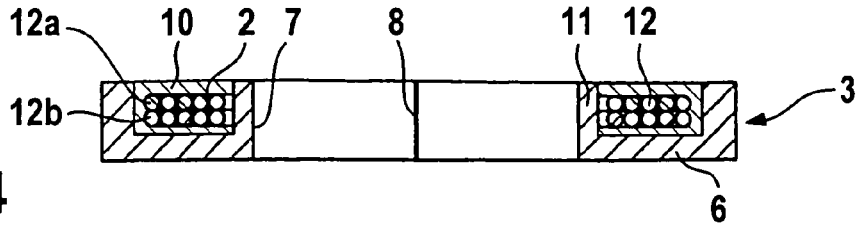
FIG. 4 shows a perpendicular section through the transformer according to section lines IV—IV of FIG. 1, whereby this section with an inserted primary coil applies in the same manner also for the two embodiments of FIGS. 2 and 3.

According to FIG. 4, the primary coil 2 is flat and disk-shaped with multiple, radially outwardly encircling windings 12, whereby the windings 12 of the primary coil 2 are wound in two parallel planes 12*a*, 12*b* with a winding gap between the two planes (not shown in the figures), such that the winding gap from one of the two planes 12, 12*b* to the other lies on the inner circumference and the two bus bars 4 lies on the outer circumference of the primary coil. The bus bars 4 project outwardly on opposite ends of the plate 6 adjacent one another.

Figure 5:
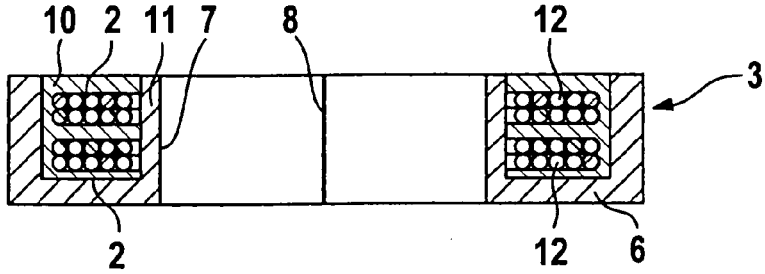
FIG. 5 shows a section corresponding to FIG. 4 through one of the transformers of FIGS. 1 through 3, whereby, however, in the cut-out in the conductive plate serving as the secondary part, two primary coils are inserted coaxially parallel adjacent to one another.
Figure 6:
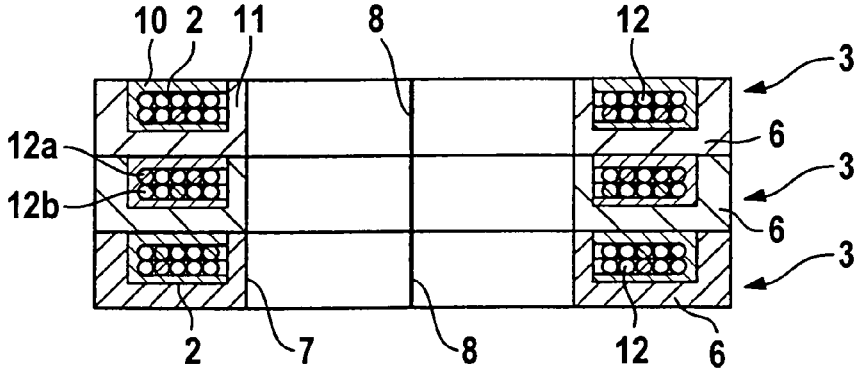
FIG. 6 shows a further section corresponding to FIG. 4 through a transformer, which is formed from three components arranged over one another in a stack with a respective primary coil according to the embodiments of FIGS. 1 through 3.

As shown in FIG. 5, also two or more primary coils 2 can be arranged in a stack on top of one another in the annular groove 9 on the plate 6 and encapsulated with insulating material 10.

With all of the embodiments shown in FIGS. 1 through 9, the primary coil 2 comprises an insulated conductor with a round, square, or tube-shaped cross section or is made from electrically conductive, disk-shaped conductors connected to and insulated from one another with a ring-shaped, central opening surrounding the cut-out 7 on the plate 6.

Figure 11:
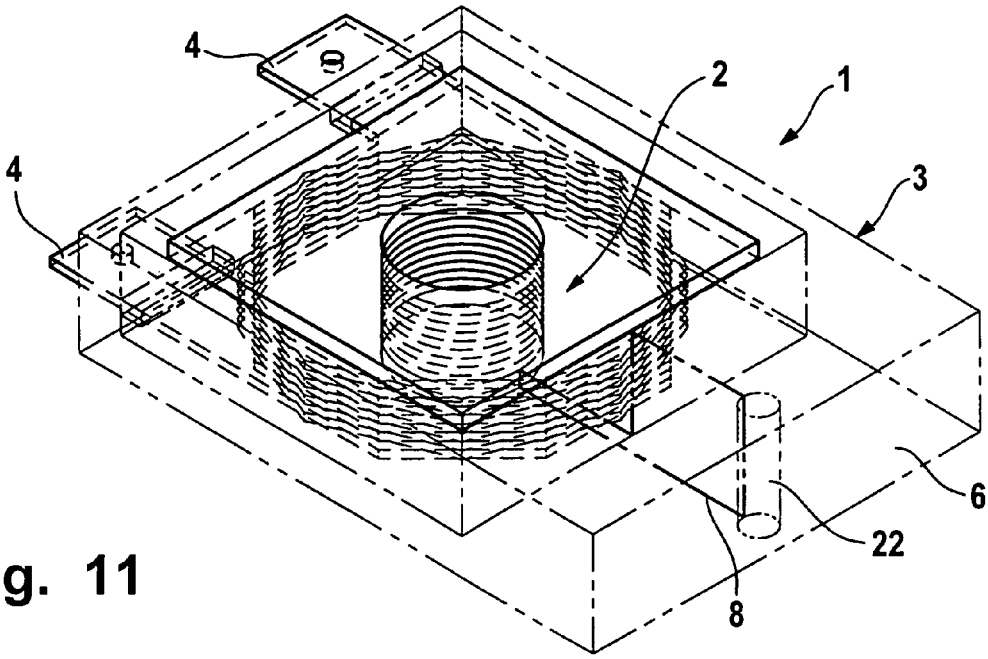
FIG. 11 shows a further transformer in perspective view, in which the primary coil with electrically conductive, disk-shaped conductors connected to one another and insulated from one another, which are rigidly braced with one another and are formed with a ring-shaped center opening surrounding the cut-out on the plate.
Figure 12:
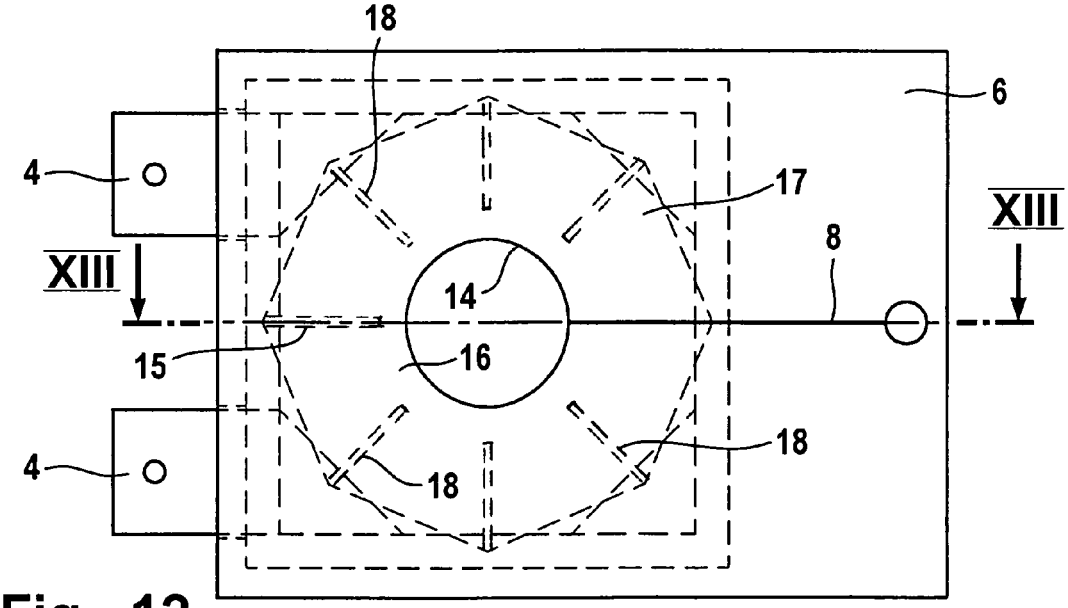
FIG. 12 is a plan view of this transformer.
Figure 13:
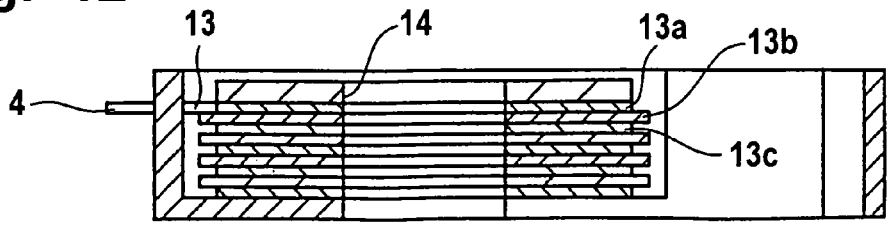
FIG. 13 shows a longitudinal section through this transformer according to sectional lines XIII—XIII in FIG. 12.

Such an embodiment with multiple, disk-shaped conductors 13 is shown in FIGS. 11 through 13. With this transformer 1, the primary coil 2 comprises multiple disks 13*a*, 13*b*, 13*c* . . . arranged in a stack and rigidly braced to one another with a central opening 14, whereby each disk 13*a*, 13*b*, 13*c* . . . has a radial slit 15 originating from the central opening 14 with electrical terminals arranged on both sides thereof, and in addition to a ring-shaped, inner region that guides the current, also has an outer region 17 for conducting heat with further radial slits 18. The individual disks 13*a*, 13*b*, 13*c* . . . are connected spirally to one another in a series. This type of coil with a disk-shaped current conductor made of multiple disks 13*a*, 13*b*, 13*c* . . . arranged in a stack with a central opening 14, which are separated from one another by insulating disks and held together by tension elements, is known from DE 36 10 690 C1. It can be used with the present transformer of FIGS. 11 through 13 in the described form as a primary coil 2.

With all of the embodiments shown, the plate 6 comprises a material with a high electrical conductivity, such as copper, aluminum, or their alloys with chromium and/or zircon, for example, Cu Cr Zr-alloys.

On each of the transformers 1, as shown in FIG. 1, at least one consumer, such as a coil 20, can be connected with an electrical cable 21.

Figure 2:
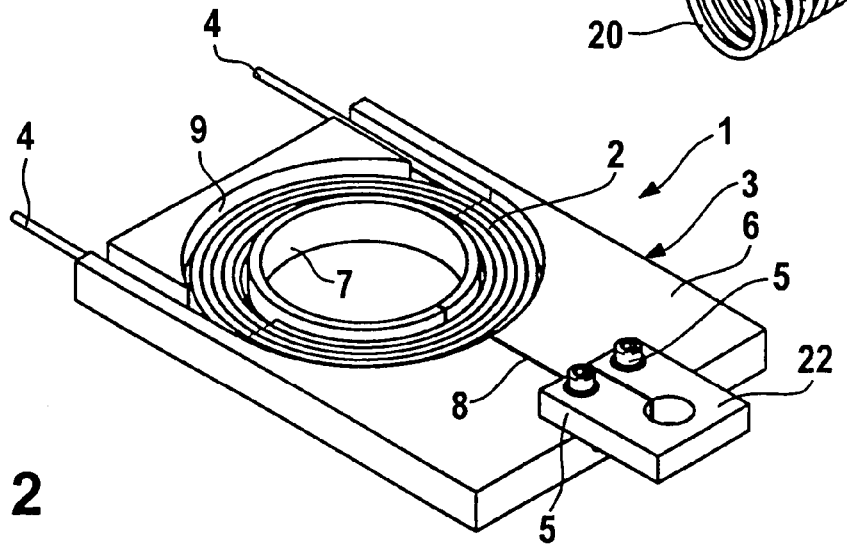
FIG. 2 shows a transformer with a magnetic field former, which is fixedly and directly mechanically mounted on the secondary part of the transformer.

Likewise, however, as shown in FIG. 2, at least one consumer, such as a magnetic field former 22, can be directly, mechanically and fixedly connected with the transformer.

Figure 3:
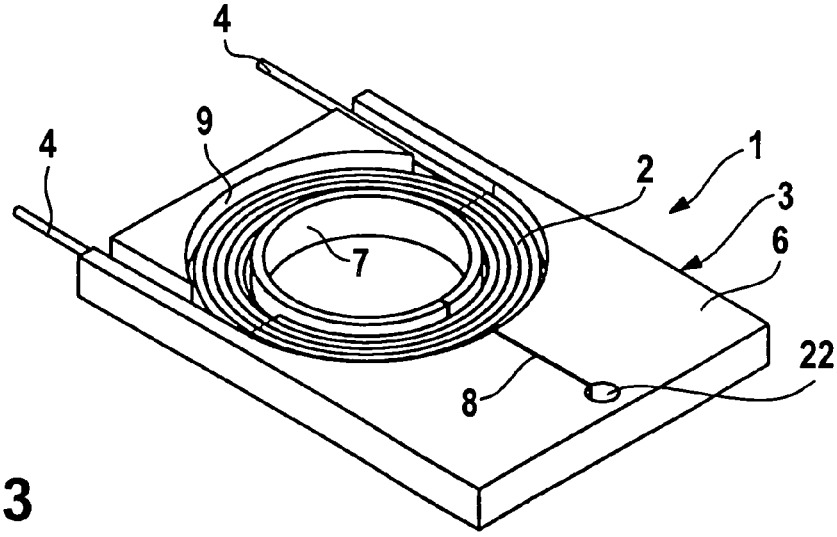
FIG. 3 shows a further, plate-shaped transformer, in which an opening for a magnetic field former is formed in the conductive plate serving as the secondary part on the ends of the slit originating from the cut-out of the primary coil.

In addition, the transformer 1 according to FIG. 3 can be formed, such that the plate 6 and at least one consumer, for example, a magnetic field former 22 formed therein, forms a closed, physical component.

Figure 10:
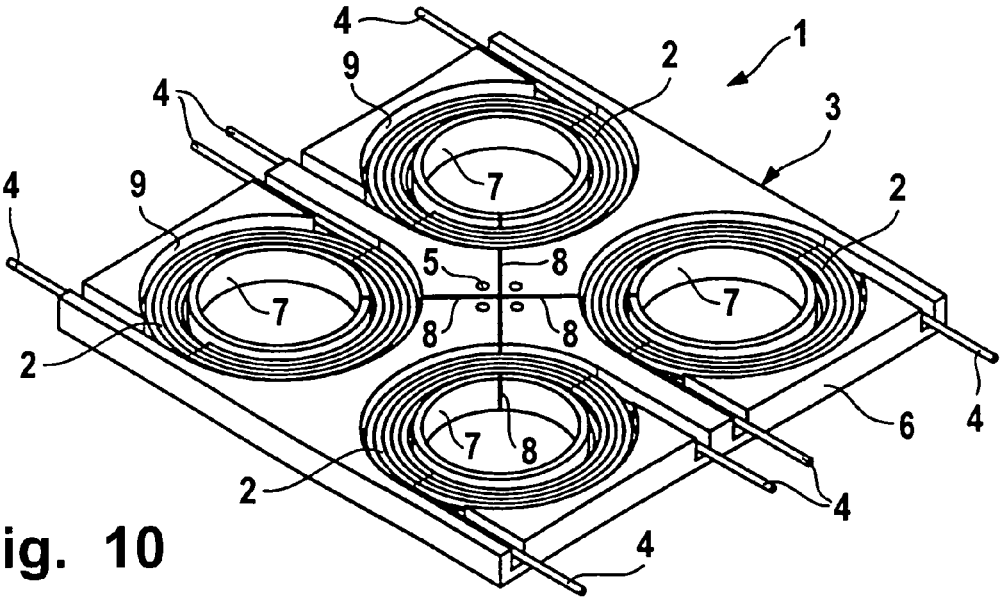
FIG. 10 shows a further plate-shaped transformer with four cut-outs, by way of example, and primary coils surrounding these cut-outs, which are arranged in annular grooves on the support plate and whose electrical terminals overhang opposite sides of the support plate.

As shown further in FIG. 10, also multiple cut-outs 7 or bores with associated annular grooves 8, primary coils 2, and slits 8, as well as multiple primary and secondary bus bars 4, 5, corresponding to the number of cu-outs 7 or bores, can be provided in the plate 6 of the transformer 1. Thus, the transformer 1 of FIG. 10, for example, comprises four primary coils 2, which are countersunk in the plate 6 with a total of four cut-outs 7 and four radial slits 8 originating therefrom for producing four, different voltages for different consumers.

Figure 7:
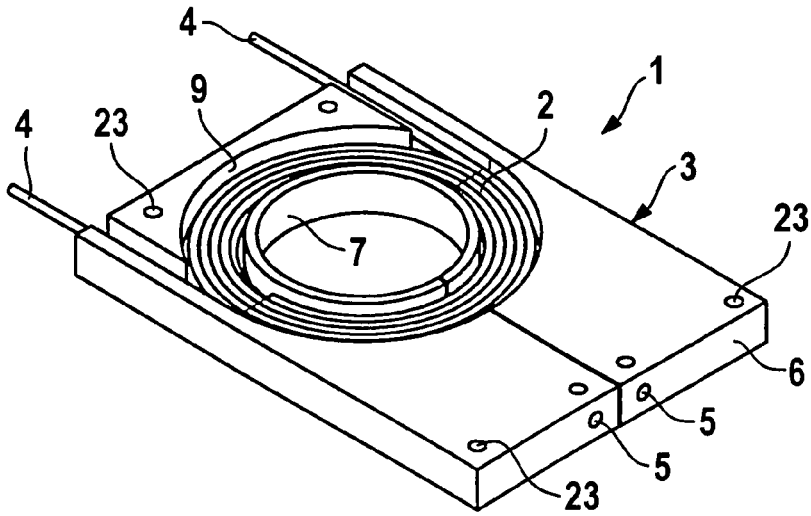
FIG. 7 shows a simply, plate-shaped transformer in the basic version with a primary coil according to FIG. 1.
Figure 8:
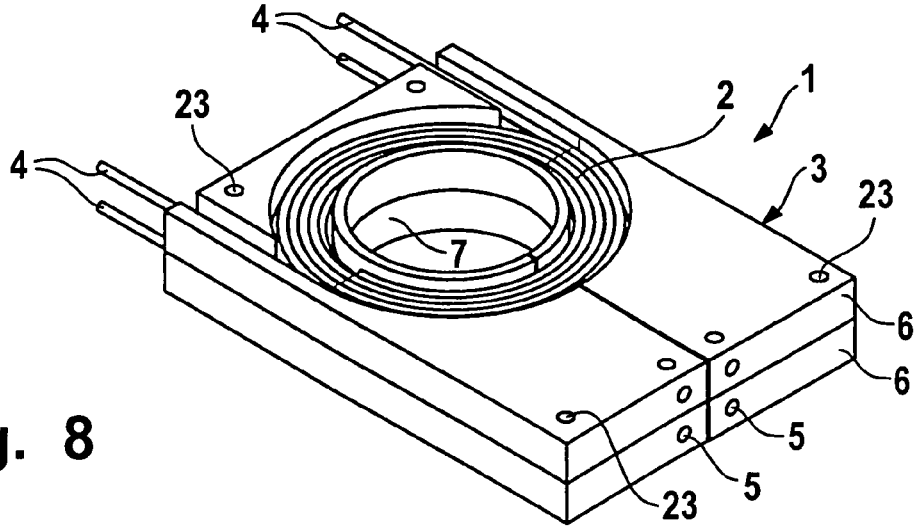
FIG. 8 shows an embodiment of two plate-shaped transformers arranged over one another in a stack.
Figure 9:
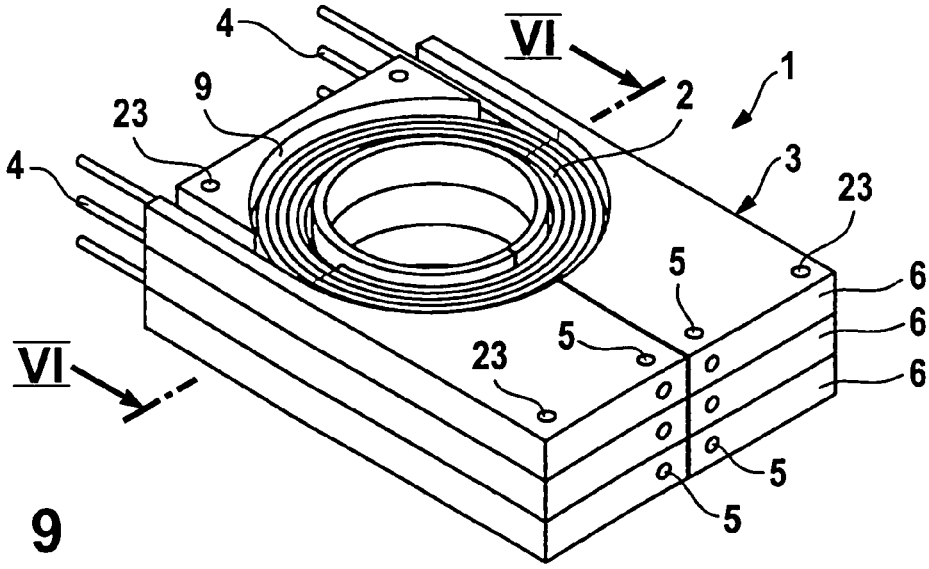
FIG. 9 shows a further, modified embodiment of a transformer with three components arranged on top of one another in a stack from FIG. 1 or FIG. 1, whereby the sectional illustration of FIG. 6 corresponds to sectional lines VI—VI of FIG. 9.

Likewise, however, as shown in FIGS. 7 through 9, also multiple identical plates 6 with aligned cut-outs or bores as well as annular grooves 9, primary coils 2, and slits 8 can be combined into a stack to form a transformer block with the associated primary and secondary bus bars 4, 5. In this connection, the plates 6 have multiple, coaxially oriented bores 23 for clamp bolts or the like, which are arranged in the edge regions of the plate 6 and penetrate and hold together the plate stack.

In order to prevent an overheating of the transformer 1, the primary coils 2 are cooled, when practical, by a liquid or gaseous medium, such as air, water, oil or nitrogen.

It will be understood that each of the elements described above, or two or more together, may also find a useful application in other types of constructions differing from the types described above.

While the invention has been illustrated and described herein as transformer for production of high electrical currents, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A transformer for producing high electrical currents used for transforming high alternating currents and power pulse currents for production of magnetic fields for magnetizing magnets and magnet systems and in conversion technology for formation of electrically conductive materials by means of a magnetic field, comprising:

at least one primary coil and at least one secondary part, wherein said at least one primary coil and at least one secondary part are connected with bus bars, wherein the secondary part of the transformer comprises at least one electrically conductive plate, wherein at least one cut-out penetrates the plate, wherein at least one slit originating from the cut-out is provided, wherein the at least one slit separates the plate on one side of each cut-out into two parts and produces the necessary bus bars, and wherein in rings about each cut-out, a primary coil with its bus bars can be inserted electrically insulated in the plate.

2. The transformer according to claim 1, wherein the cut-out on the plate is surrounded by an annular ring that receives the primary coil, wherein the primary coil is inserted into the annular groove and encapsulated with insulating material.

3. The transformer according to claim 1, wherein the plate has a separating wall encircling the cut-out and projecting over the primary coil on an inner circumference.

4. The transformer according to claim 1, wherein the annular groove has a substantially U-shaped cross section and opens toward a flat side of the plate.

5. The transformer according to claim 1, wherein the cut-out on the plate has a round or polygonal cross section.

6. The transformer according to claim 1, wherein the primary coil is formed flat and disk-shaped with multiple windings encircling radially outward.

7. The transformer according to claim 6, wherein the windings of the primary coil are coiled in two parallel planes with a winding gap between the two planes, such that the winding gap lies on an inner circumference from one of the two planes to the other and the two bus bars lie on an outer circumference of the primary coil.

8. The transformer according to claim 1, wherein two or more primary coils are countersunk in a stack on one another in the plate.

9. The transformer according to claim 1, wherein the primary coil comprises an insulating conductor with a round, square, or tube-shaped cross section or electrically conductive conductors connected to one another and insulated from one another with a central opening surrounding the cut-out of the plate in a ring.

10. The transformer according to claim 9, wherein the primary coil comprises multiple disks arranged in a stack and fixedly wire-braced with one another with a central opening, and wherein each disk has a radial slit originating from the central opening with electrical terminals arranged on two sides, a ring-shaped inner region for guiding current and an outer region for conducting heat with broad radial slits, and wherein the individual disks are spirally connected with one another in a series.

11. The transformer according to claim 1, wherein the plate comprises a material with a high electrical conductivity, wherein the material is selected from the group consisting of copper, aluminum, or alloys of copper and aluminum with chromium and/or zirconium, for example, Cu Cr Zr-alloys.

12. The transformer according to claim 1, wherein at least one consumer, such as a coil, is connected to the transformer with an electrical cable.

13. The transformer according to claim 1, wherein at least one consumer, such as a magnetic field former, is connected mechanically fixedly with the transformer.

14. The transformer according to claim 1, wherein the plate and at least one consumer form a closed, physical component.

15. The transformer according to claim 1, wherein in the plate, multiple cut-outs or bores are provided with associated annular grooves, primary coils, and slits, as well as multiple primary and secondary bus bars corresponding to the number of the cut-outs or bores.

16. The transformer according to claim 1, wherein multiple, identically formed plates are combined with overlapping cut-outs or bores, annular grooves, primary coils, and slits in a stack to form a transformer block with associated primary and secondary bus bars.

17. The transformer according to claim 16, wherein the plates have multiple coaxially directed bores for clamping bolts, which penetrate and hold together the plate stack.

18. The transformer according to claim 1, wherein the primary coils are cooled by a liquid or gaseous medium, wherein the medium is selected from the group consisting of air, water, oil, or nitrogen.

* * * * *